United States Patent [19]

Nishimura et al.

[11] Patent Number: 5,007,617

[45] Date of Patent: Apr. 16, 1991

[54] HAND-OPERATED CHAIN BLOCK

[75] Inventors: Yosaku Nishimura, Osaka, Japan; Glenn S. Smith, Issaquah, Wash.

[73] Assignee: Vital Kogyo Kabushiki Kaisha, Osaka, Japan

[21] Appl. No.: 389,602

[22] Filed: Aug. 3, 1989

[51] Int. Cl.[5] ..... B66D 1/28

[52] U.S. Cl. ..... 254/372; 254/358

[58] Field of Search ..... 254/372, 358

[56] References Cited

U.S. PATENT DOCUMENTS

| | | | |
|---|---|---|---|
| 126,391 | 5/1872 | Hall | 254/403 |
| 349,520 | 9/1886 | Samuel | 474/140 |
| 385,856 | 7/1888 | Hambay | 254/343 |
| 428,675 | 5/1890 | Holt | 474/140 |
| 577,330 | 2/1897 | Speidel | 254/358 |
| 2,637,525 | 5/1953 | Lock | 254/269 |
| 3,030,076 | 4/1962 | Stevens | 254/358 |
| 3,894,720 | 7/1975 | Koji | 254/372 X |
| 4,221,364 | 9/1980 | Nishimura | 254/338 |
| 4,792,323 | 12/1988 | Flaig | 254/372 X |

FOREIGN PATENT DOCUMENTS

| | | |
|---|---|---|
| 48-19725 | 6/1973 | Japan . |
| 49-36204 | 10/1974 | Japan . |
| 8205 | of 1893 | United Kingdom . |

*Primary Examiner*—Katherine Matecki

*Attorney, Agent, or Firm*—Christensen, O'Connor, Johnson & Kindness

[57] ABSTRACT

A hand-operated chain block having a hand chain wheel portion light in weight and simplified in construction and which permits safe and smooth hand chain operation. A hand chain wheel cover is mounted on a plurality of stays disposed on side plates of a chain block body in such a manner as to cover the upper, lower and front portions of the hand chain wheel, and a pair of hand chain guide plates are mounted on an upper pair of stays to cover the side portions of the hand chain wheel, thereby covering substantially the entire periphery of the hand chain wheel. Each of the hand chain guide plates is formed of one metal plate in a folded pattern, and the pivotal support portion at its upper end part is inserted into the upper stay, and the hand chain guide plate is oscillatably suspended and supported, while a hand chain wound around the hand chain wheel is inserted through a hand chain guide portion formed at the lower end portion so as to be guided. A guide plate fixing member is detachably fitted to a lower stay to simultaneously fix the lower end portion of each of the hand chain guide plate.

4 Claims, 3 Drawing Sheets

HAND-OPERATED CHAIN BLOCK

BACKGROUND OF THE INVENTION

1. Field of the Invention

This invention relates to hand-operated chain blocks and, more particularly, to a hand-operated chain block which is light in weight and simple in construction with respect to its hand chain wheel portion and which permits safe and smooth hand chain operation.

2. Description of the Prior Art

Hitherto, various different types of hand chain wheel construction for hand operated chain blocks have been developed which are provided with measures for safe hand chain operation and which are reduced in weight and simplified in construction for the purpose of reduction in weight of the entire chain block.

In such situation, the present applicant has already proposed two types of chain block construction, namely, one disclosed in Japanese Utility Model Publication No. 19725/1973, and the other disclosed in Japanese Utility Model Publication No. 36204/1974.

The chain block disclosed in Japanese Utility Model Publication No. 19725/1973 comprises a positioning dowel formed on a hand chain guide plate, and a small slit formed in a hand chain wheel cover, the hand chain guide plate being adapted to be fixedly mounted to the chain block by a stay for hand chain wheel cover mounting and through engagement of the dowel with the small slit. The hand chain guide plate has a guide portion formed in such an overhanging pattern that it covers an upper edge portion of a side window of the hand wheel chain cover.

The other chain block disclosed in Japanese Utility Model Publication No. 36204/1974 has a hand chain cover of such split-type construction that it consists of an upper cover having a key-shaped section which covers a front upper peripheral portion of a hand chain wheel and a U-shaped lower cover which covers a front peripheral portion of the hand chain wheel other than covered by the upper cover. The lower cover is formed of a plate material having greater thickness than the upper cover and has at its opposite side ends a hand-chain guide plate integrally formed therewith. Opposite side ends of a front plate portion of the upper cover are placed in superposed relation with the corresponding ends of an upper portion of the lower cover, the superposed portions being secured by a common bolt to side plates of a chain block body, a median portion of the lower cover being secured by another bolt to the side plates.

However, these types of chain block construction are not fully satisfactory because of a number of deficiencies found therewith which are pointed out below; hence, further improvement has been demanded.

In the first mentioned disclosure, i.e., Japanese Utility Model Publication No. 19725/1973, the mounting arrangement for the hand chain guide plate is comparatively simple in itself, but the work required for engagement of the positioning dowel with the small slit in connection with the mounting of the guide plate is troublesome, which fact is disadvantageous from the standpoint of assembly work efficiency.

Another difficulty is that since the guide portion of the hand chain guide plate is located in an upper edge portion of the hand chain wheel cover, the entire side portions of the hand chain wheel are open and accordingly the hand chain is outwardly exposed, which fact is disadvantageous from the stand point of safety because the operator may possibly touch the hand chain wheel portion by hand at the open side portion, or because some falling object may possibly become engaged by the wheel portion.

In the second mentioned disclosure, i.e., Japanese Utility Model Publication No. 36204/1974, the guide plates for guiding the hand chain are small-sized plates provided at opposite ends of the lower cover and therefore the side portions of the hand chain wheel are substantially entirely open, which fact is disadvantageous from the standpoint of safety as is the case with the first mentioned disclosure.

Another drawback is that the lower cover for the hand chain wheel is comparatively thick walled, so that further reduction in weight is required of it, while on the other hand reduction in thickness for such purpose may possibly result in decreased strength of the lower cover.

Furthermore, both of the foregoing chain blocks have a deficiency in that in the case where the hand chain is pulled at comparatively high speed, if such operation is made in such condition that, for example, no load is being hung by a load chain, possible twists (snarls) cannot completely be straightened out by the hand chain guide plate. This means that the hand chain is wound in twisted condition around the hand chain wheel, smooth hand chain operation being thus prevented.

BRIEF SUMMARY OF THE INVENTION

This invention is intended to overcome the aforesaid difficulties with the prior art, and accordingly it is a primary object of the invention to provide a novel hand-operated chain block which further improves the present applicant's prior U.S. patent application Ser. No. 07/236,031, now U.S. Pat. No. 4,881,720.

It is another object of the invention to provide a hand-operated chain block which is safety-oriented, light in weight, and simple in construction with respect to its hand chain portion, and which assures smooth hand chain operation.

It is a further object of the invention to provide a hand-operated chain block which can utilize an existing cover mounting stay as such for hand chain wheel mounting, and which can serve for purposes of simplification of and weight reduction in chain block construction and facilitate ease of assembly, thereby contributing toward improved productivity, and manufacturing cost and production cost reduction.

It is another object of the invention to provide a hand-operated chain block which has a hand chain guide plate formed by bending of one metal plate, with a pivotal support portion crookedly formed at an upper portion thereof and a hand chain guide portion formed at a lower portion thereof, and which is therefore very light in weight, simple in construction without its total weight being increased and yet is of sufficient strength.

It is a still further object of the invention to provide a hand-operated chain block which is free of any possibility of hand chain disengagement or snarling and of any danger of the operator touching the hand chain wheel portion by hand or of any dropping object being engaged by such wheel portion, and which assures a very high degree of safety.

It is another object of the invention to provide a hand-operated chain block which has a hand chain guide plate oscillatably suspended and supported by a pair of upper stays, and has a guide plate fixing member detachably fitted to the lower middle stay, so that part of the lower end portion of said hand chain guide plate may be fixed simultaneously, thereby conforming to the statutory standard of use, safety standard or field conditions of use, and enabling to select properly the fixed state and oscillating state of the hand chain guide plate.

It is still another object of the invention to provide a hand-operated chain block which can prevent contact of the hand chain with the hand chain wheel cover by the lower horizontal portion even when the hand chain is operated obliquely so that generation of contact noise may be avoided.

The hand-operated chain block in accordance with the present invention comprises a load sheave rotatably supported between a pair of side plates, a hand chain wheel disposed at the opposite side of the load sheave at one of said side plates and mechanically coupled to said load sheave, and enclosing means for covering nearly the entire periphery of said hand chain wheel, wherein said enclosing means consists of a plurality of stays, a hand chain wheel cover, a pair of hand chain guide plates, and guide plate fixing members, and said plurality of stays are disposed around the hand chain wheel at the opposite side of one of the side plates, two of them are positioned upward the rotary shaft of the hand chain wheel when the hand-operated chain block is suspended from above, while the other one is positioned at the central position of the interval of the above two pieces beneath the rotary shaft of the hand chain wheel, and the hand chain wheel cover is a pie-shaped section, i.e., is shaped similar to a section of pie, and is mounted on said plurality of stays so as to cover the upper and lower part and front portion of the hand chain wheel, each of said hand chain guide plates is mounted one of the two of said plurality of stays in a manner to cover the side portion of the hand chain wheel, each of said hand chain guide plates is made of one metal plate in a folded pattern, a pivotal supporting portion is curved and formed at its upper end portion, and a tube-shaped hand chain guide portion is formed in the lower end portion thereof, said pivotal supporting portion is penetrated into one of said two stays, the hand chain guide plate is oscillatably suspended and supported on said stay, the hand chain wound on the hand chain wheel is penetrated into the hand chain guide portion and is guided by the hand chain guide portion, and the guide plate fixing member is detachably fitted to one stay, so that part of the lower end portion of the both hand chain guide plates may be fixed simultaneously.

The above and other related objects and features of the invention will be apparent from the following description of the disclosure found in the accompanying drawings and the novelty thereof point out in the appended claims.

DETAILED DESCRIPTION OF THE PREFERRED EMBODIMENT

Figure 1:
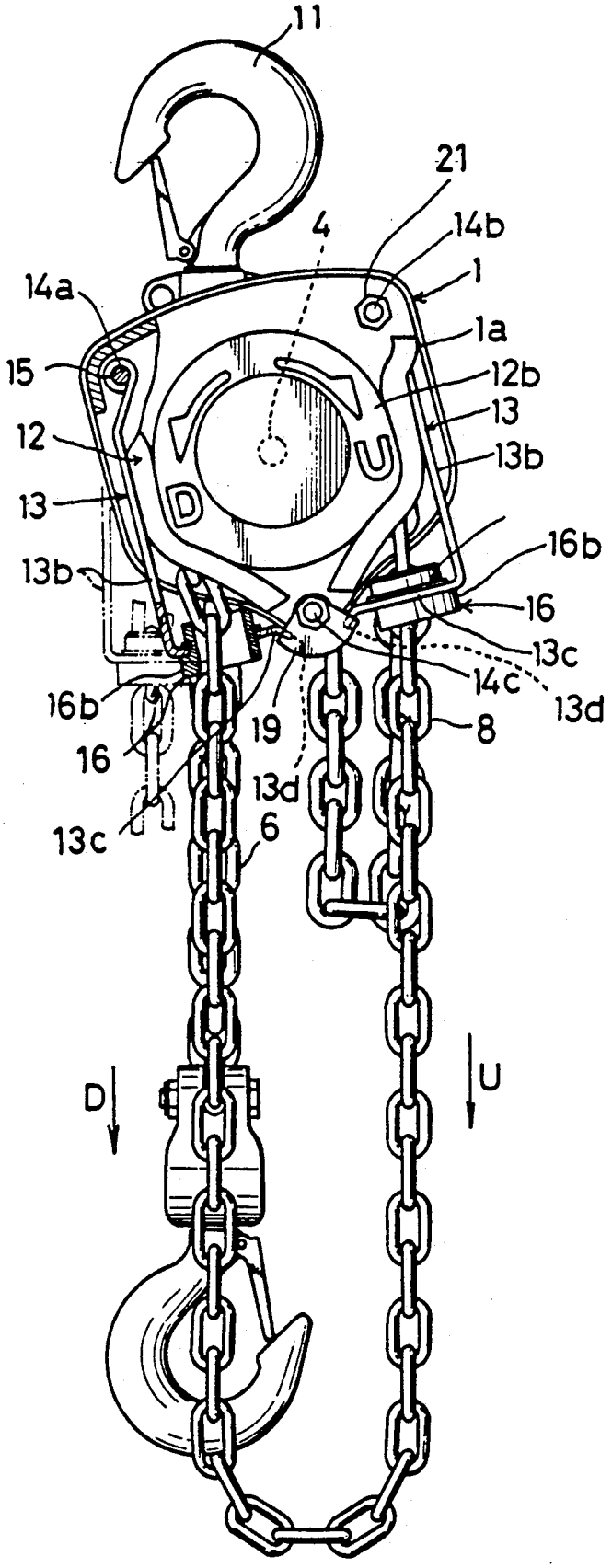
FIG. 1 is a partially cut-away front view of a hand-operated chain block according to one of the embodiments of the invention, in which the solid line denotes the state of the hand chain guide plate being fixed by the guide plate fixing member, and the double dot chain line indicates the oscillatable state of the hand chain guide plate.
Figure 2:
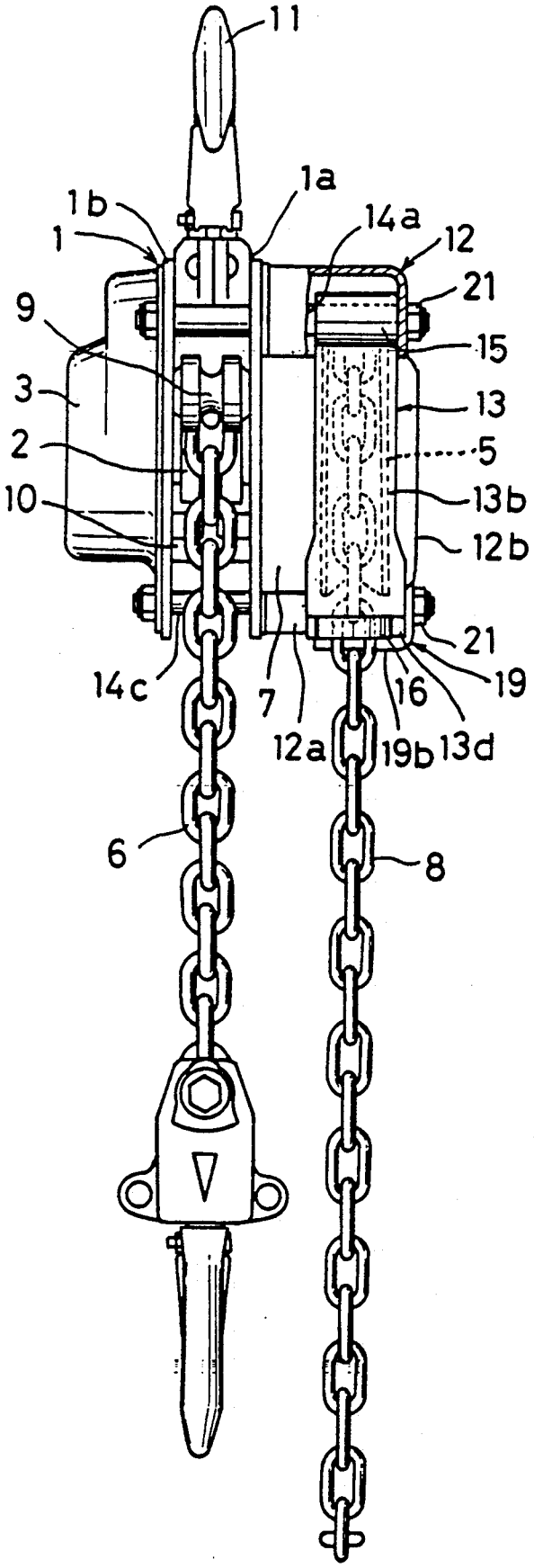
FIG. 2 is a side view of the same chain block.

A hand-operated chain block embodying the invention is shown in FIGS. 1, 2. The chain block comprises, among others, a chain block body 1, a load sheave 2, a reduction gear mechanism 3, a drive shaft 4, and a hand chain wheel 5. The load sheave 2 is rotatably supported between front and rear side plates 1*a*, 1*b* composing the chain block body 1, and a load chain 6 is wound therearound. The load sheave 2 is also coupled to the drive shaft 4 by way of the reduction gear mechanism 3, and the drive shaft 4 is coupled with the hand chain wheel 5 by way of a friction plate mechanism 7, and a hand chain 8 is wound thereon.

The drive shaft 4 is rotatably supported in the load sheave 2, and the construction of principal parts is well known, and therefore the description thereof is omitted. Numeral 9 is a guide for guiding the load chain 6, 10 is a stripper for preventing the load chain 6 from snarling, and 11 is a hook for suspending the chain block body 1.

The hand chain wheel 5 is of such construction that substantially the entire periphery of the chain wheel 5 is covered by enclosing means, and this enclosing means comprises a hand chain wheel cover 12 and hand chain guide plates 13, 13 as principal components.

The hand chain wheel cover 12 is shaped in a pie-shaped section as shown in FIG. 1. The hand chain wheel cover 12 is fastened with nuts 21 to three stays 14*a*, 14*b*, 14*c* disposed at front and rear side plates 1*a*, 1*b* of the chain block body 1, thereby covering the upper and lower parts and the front portion of the hand chain wheel 5. The middle portion of the lower end portion of the hand chain wheel cover 12 is fixed to the lower middle stay 14*c*, and possesses a cover portion 12*a* with an arc-shaped section covering the lower outside of the stay 14*c*.

The hand chain guide plates 13, 13 are oscillatably suspended and mounted on stays 14*a* and 14*b* at the right and left side of the upper portion of said hand chain wheel 5 and cover the side openings of the hand chain wheel cover 12, that is, the right and left side portions of the hand chain wheel 5.

Figure 3:
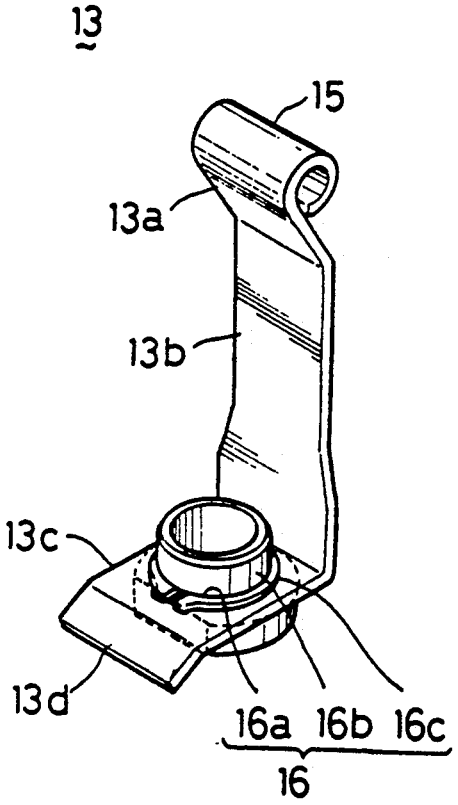
FIG. 3 is a perspective view of the hand chain guide plate of the same chain block.
Figure 4:
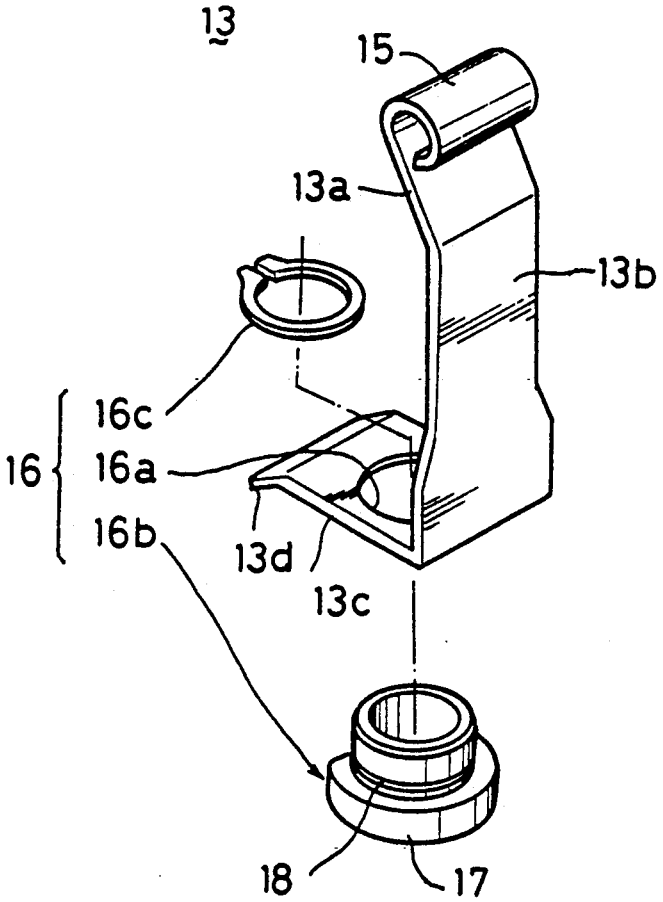
FIG. 4 is a perspective exploded view of the hand chain guide plate shown in FIG. 3.

Each of the hand chain guide plates 13 is made of a metal plate folded in an approximately L-shape as shown in FIGS. 3, 4.

The upper portion 13*a* of the hand chain guide plate 13 is folded inward with a slight slant, and its upper end portion is curved outward in an arc section, thereby forming a pivotal supporting part 15. This pivotal supporting part 15 is inserted into the upper stay 14*a* or 14*b*, so that the hand chain guide plate 13 is oscillatably suspended and supported at the rear side of a front plate part 12*b* of the hand chain wheel cover 12.

The middle part 13*b* of the hand chain guide plate 13 is mounted on the stays 14*a* and 14*b*, to cover the outside of the hand chain 8, and acts to guide smoothly the hand chain 8 together with a hand chain guide part 16 mentioned later.

The lower part 13*b* of the hand chain guide plate 13 is bent horizontally inward, and the hand chain guide part 16 is formed in the lower horizontal portion 13*c*.

The hand chain guide part 16 is composed, as shown in FIG. 4, by fixing a cylinder 16*b* into a mounting hole 16*a* penetrating through the lower horizontal portion 13*c* by means of a locking ring 16*c*. That is, the size of the cylinder 16*b* is defined so that its inside diameter allows the hand chain 8 to pass through and that the outside diameter may penetrate through the mounting hole 16*a*. At the lower end of the cylinder 16*b*, a lower flange 17 abutting against the lower face of the lower horizontal portion 13*c* is provided, and an annular fitting hole 18 fitting the locking ring 16*c* is disposed on the outer periphery above the upper surface of the lower flange 17 by the portion of the wall thickness of the lower horizontal portion 13*c*.

Thus, after the cylinder 16*b* is inserted into the mounting hole 16*a* of the lower horizontal portion 13*c* from the lower side, and the locking ring 16*b*, is fitted into the fitting groove 18 of the cylinder 16*b* projecting upward from the lower horizontal portion 13*c*, thereby forming the hand chain guide part 16.

In this hand chain guide part 16, the hand chain 8 wound on the hand chain wheel 5 is inserted and guided. The hand chain guide part 16, in addition to the guiding action of the hand chain 8, also possesses the action of preventing twisting (snarling) when the hand chain 8 passes through the hand chain guide part 16. This twisting preventive action is particularly effective when, for example, the hand chain 8 is pulled at a relatively high speed while the load is not suspended on the load chain 6.

The front end portion of the lower horizontal portion 13*c*, that is, the inner end portion 13*d* is slightly bent downward so as to abut against and mesh with the cover portion 12*a* of the hand chain wheel cover 12. As a result, as shown in FIG. 1, even if the chain block body 1 is tilted by pulling the hand chain 8, the hand chain 8 does not contact with the hand chain wheel cover 12.

Figure 5:
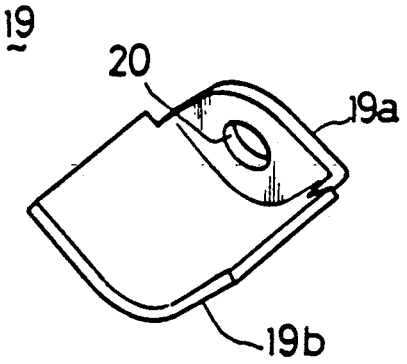
FIG. 5 is a perspective view showing the guide plate fixing member of the same chain block.

On the lower middle stay 14*c*, a guide plate fixing member 19 is detachably attached from the outside of the hand chain wheel cover 12. The guide plate fixing member 19 is made of one metal plate in a folded pattern as shown in FIG. 5. The guide plate fixing member 19 is composed of a mounting portion 19*a* having an insertion hole 20 for inserting the stay 14*c*, and a fixing portion 19*b* having an arc section corresponding to the sectional shape of the cover portion 12*a* of the hand chain wheel cover 12.

By this guide plate fixing member 19, the hand chain guide plates 13, 13 are designed to be selected between the fixed state and oscillatable state depending on the statutory standard of use, safety rules and field conditions of use. In other words, when the abutting portions 13*d*, 13*d* of the hand chain guide plates 13, 13 are simultaneously pinched and fixed between the fixing portion 19*b* of the guide plate fixing member 19 and the cover portion 12*a* of the hand chain wheel cover 12, the both hand chain guide plates 13, 13 are fixed with respect to the chain block body 1. On the other hand, when the abutting portions 13*d*, 13*d* are allowed to abut against and engage with the outer side of the fixing portion 19*b* of the guide plate fixing member 19, the both hand chain guide plates 13, 13 are in a freely oscillatable state with respect to the stays 14*a*, and 14*b*.

In thus composed chain block, by pulling the hand chain 8 in the load lifting direction U, this tensile force is transmitted to the load sheave 2 by way of the hand chain wheel 5, friction plate mechanism 7, drive shaft 4 and reduction gear mechanism 3, and hence the load sheave 2 is rotated in the hoisting-up direction, so that the wound load chain 6 is lifted up.

On the other hand, by pulling the hand chain 8 in the load lowering direction D, the load chain 6 is pulled down by the reverse action of the above.

In this case, the hand chain 8 is guided by the hand chain guide plates 13, 13, and a smooth pulling action is guaranteed, and its twisting is effectively prevented. The guiding function of this hand chain guide plates 13, 13 is particularly effective in the case of hand chain operation while the load is not suspended from the load chain 6, for instance.

That is, the pulling operation of the hand chain 8 while a load is not suspended from the load chain 8 is relatively at high speed, and the upper part of the hand chain 8 tends to bulge outward by the inertia (the lateral direction in FIG. 1), but this bulging is prevented as hitting against the middle parts 13*b*, 13*b*, so that winding of the hand chain 8 on the hand chain wheel 5 may be effected smoothly.

In the location where the hand chain 8 is wound up on the hand chain wheel 5, a guide part (not shown) for unwinding the twist of the hand chain 8 is provided, when the pulling action of the hand chain 8 is operated at high speed as mentioned above, it is not possible to function sufficiently with this guide portion alone. Such incidence can be completely prevented by the hand chain guide part 16.

In other words, when the hand chain 8 passes through the cylinder 16*b* of the hand chain guide part 16, the twist occurring in the hand chain 8 due to the action of the internal cylindrical surface of the cylinder 16*b* is promptly and smoothly canceled, and a smooth hand chain operation is assured.

Besides, since the upper part of the hand chain 8, that is, the portion wound up on the hand chain wheel 5, is covered with the hand chain guide plates 13, 13 and is not exposed outside, the risk of contact of the hand chain wheel by the hand from this location or contact of a falling object may be avoided, so that a sufficient safety is guaranteed.

Furthermore, when the hand chain guide plates 13, 13 are in the oscillatable state about the upper right and left stays 14*a* and 14*b* and even when the hand chain 8 is operated obliquely to the hand chain wheel 5, immoderate force is not applied on the hand chain guide plates 13, 13, and the hand chain guide action may always be effective (see the double dot chain line in FIG. 2).

Furthermore, since the lower horizontal portion 13*c* is bent inward to keep a specific distance from the hand chain wheel cover 12, even if the hand chain 8 is operated from an oblique position as mentioned above, contact of the hand chain 8 with the hand chain wheel cover 12 is prevented, and generation of contact noise is avoided.

It is understood that the embodiment illustrated in the detailed description of the invention is intended to clarify the subject matter of the invention by way of example, and therefore the invention is not limited by the embodiment and should not be interpreted in a narrow sense, but rather it should be interpreted in a broader sense in that various modifications may be made within the spirit and scope of the invention as hereinafter claimed.

What is claimed is:

1. A hand-operated chain block comprising a load sheave rotatably supported by and between a pair of side plates, a hand chain, a hand chain wheel positioned a first surface of one of said side plates facing away from said load sheave mechanically coupled to said load sheave, and enclosing means for substantially enclosing entire periphery of said hand chain wheel, wherein said enclosing means consists of a plurality of stays, a hand chain wheel cover, a pair hand chain guide plates, and a guide plate fixing member, said plurality of stays are mounted on said first surface of one of said side plates about said hand chain wheel, a first and a second stay are positioned above the axis of rotation of said hand chain wheel when said hand-operated chain block is suspended from above, while a third stay is positioned beneath the axis of rotation of the hand chain wheel, said hand chain wheel cover possesses a pie-shaped section, and is mounted on said plurality of stays so as to partially cover said hand chain wheel, each of said hand chain guide plates is mounted on one of said first and second stays and covers a portion of said hand chain wheel which is perpendicular to its axis of rotation, each of said hand chain guide plates includes a metal plate in a folded pattern with a pivotal support portion formed at an upper end portion thereof in a curved pattern, and with a tubular hand chain guide portion formed at a lower end portion thereof, said pivotal support portion of said hand chain guide plates encircling said first and second stays so that said hand chain guide plates are oscillatably suspended and supported by said first and second stays, the hand chain wound on said hand chain wheel passes through said hand chain guide portion, being guided by said hand chain guide portion, and said guide plate fixing member is mounted on said stay, so that part of the lower end portion of both hand chain guide plates may be simultaneously.

2. A hand-operated chain block according to claim 1, wherein said hand chain wheel cover includes a cover portion in an arc-shaped section which partially encircles said third stay, the lower end portion of each hand chain guide plate includes an abutting portion to abut against and mesh with the outer surface of said cover portion, said guide plate fixing member is made of one metal plate in a folded pattern, and includes a fixing portion having an arc-shaped section such that its shape corresponds to said cover portion of said hand chain wheel cover to allow the abutting portion of both hand chain guide plates to be simultaneously held and fixed between the fixing portion of said guide plate fixing member and the cover portion of said hand chain wheel cover.

3. A hand-operated chain block according to claim 2, wherein each hand chain guide plate is folded in an approximately L-shape having a vertical portion and a lower horizontal portion, the vertical portion of said hand chain guide plate is bent in an arc-shaped section, and said pivotal support portion is formed therein, said hand chain guide portion is formed in the lower horizontal portion of said hand chain guide plate and includes a hole with a diameter large enough to allow said hand chain to pass therethrough, and said abutting portion is formed with the end portion of said lower horizontal portion.

4. A hand-operated chain block according to claim 3, wherein said hand chain guide portion includes a mounting hole passing through the lower horizontal portion of said hand chain guide plate, a cylinder having an inside circumference large enough to allow said hand chain to pass through and an outside circumference small enough to penetrate through said mounting hole, and a locking ring for elastically fitting said cylinder, and said cylinder includes a flange for abutment against the lower surface of said lower horizontal portion of said hand chain guide plate, and an annular fitting groove for fitting said locking ring on the outer periphery of the cylinder at a position above said lower horizontal portion of the hand chain guide plate.

* * * * *

UNITED STATES PATENT AND TRADEMARK OFFICE

CERTIFICATE OF CORRECTION

PATENT NO. : 5,007,617

DATED : April 16, 1991

INVENTOR(S) : Y. Nishimura et al.

It is certified that error appears in the above-identified patent and that said Letters Patent is hereby corrected as shown below:

| COLUMN | LINE | |
|---|---|---|
| 5 | 15 | Delete "16b," and insert therefor --16b-- |
| 5 | 63 | Delete "14a," and insert therefor --14a-- |
| 7 | 3 | After "enclosing" insert --the-- |
| 7 | 6 | After "pair" insert --of-- |
| 7 | 36 | After "said" (second occurrence) insert --third-- |
| 7 | 38 | After "be" insert --fixed-- |

Signed and Sealed this

Twenty-second Day of December, 1992

*Attest:*

DOUGLAS B. COMER

*Attesting Officer*

*Acting Commissioner of Patents and Trademarks*